US010337774B2

(12) United States Patent
Arbogast et al.

(10) Patent No.: US 10,337,774 B2
(45) Date of Patent: Jul. 2, 2019

(54) REFRIGERATION APPLIANCE WITH AN INTERNAL EVAPORATOR

(71) Applicant: BSH HAUSGERAETE GMBH, Munich (DE)

(72) Inventors: Markus Arbogast, Heidenheim (DE); Thomas Schaefer, Giengen (DE); Marcus Wehlauch, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 112 days.

(21) Appl. No.: 15/616,977

(22) Filed: Jun. 8, 2017

(65) Prior Publication Data

US 2017/0363335 A1 Dec. 21, 2017

(30) Foreign Application Priority Data

Jun. 15, 2016 (DE) ..... 10 2016 210 707

(51) Int. Cl.

| | |
|---|---|
| ***F25B 39/00*** | (2006.01) |
| ***F25D 21/08*** | (2006.01) |
| ***F25D 21/14*** | (2006.01) |
| ***F25B 39/02*** | (2006.01) |
| ***F25D 23/00*** | (2006.01) |

(52) U.S. Cl.

CPC ..... *F25B 39/00* (2013.01); *F25B 39/02* (2013.01); *F25D 21/14* (2013.01); *F25D 23/006* (2013.01); *F25D 21/08* (2013.01); *F25D 2331/809* (2013.01)

(58) Field of Classification Search

CPC ..... F25B 39/00; F25B 39/02; F25D 21/14; F25D 23/006; F25D 21/08; F25D 2331/809

See application file for complete search history.

(56) References Cited

U.S. PATENT DOCUMENTS

2008/0314662 A1* 12/2008 Bogelein ..... B60K 1/04 180/68.5
2012/0047934 A1* 3/2012 Park ..... F25D 17/062 62/264

* cited by examiner

*Primary Examiner* — Melvin Jones
(74) *Attorney, Agent, or Firm* — Laurence A. Greenberg; Werner H. Stemer; Ralph E. Locher

(57) ABSTRACT

A refrigeration appliance has an inner container, which separates at least one storage compartment for refrigerated goods and an evaporator assembly from a surrounding heat insulation layer. A mounting element contains a base plate resting against a wall of the inner container and opposing a broad side of the evaporator assembly and retaining webs which project from the base plate and engage in a form-fit manner in two narrow sides of the evaporator assembly.

18 Claims, 2 Drawing Sheets

REFRIGERATION APPLIANCE WITH AN INTERNAL EVAPORATOR

CROSS-REFERENCE TO RELATED APPLICATION

This application claims the priority, under 35 U.S.C. § 119, of German application DE 10 2016 210 707.0 filed Jun. 15, 2015; the prior application is herewith incorporated by reference in its entirety.

BACKGROUND OF THE INVENTION

Field of the Invention

The present invention relates to a refrigeration appliance, in particular a domestic refrigeration appliance, in which an evaporator together with a storage compartment, cooled thereby, for refrigerated goods is arranged in the interior of an inner container.

To enable easy assembly of the evaporator, this must be held securely in its position in the inner container, even before the refrigerant pipe of the evaporator is fitted into the refrigerant circuit and before, if applicable, a separating wall which separates an evaporator chamber from the storage compartment is assembled.

One known possibility for this is to mold holding contours on opposing side walls of the inner container, the holding contours interacting with complementary contours on front ends of an evaporator assembly so that the evaporator assembly can be introduced into a position in the interior of the inner container, in which the holding contours of the inner container and the evaporator assembly engage with one another, and is provisionally held in this position so that further assembly work can be carried out quickly and efficiently.

One problem of this known technology is that the distance between the opposing side walls is variable depending on the housing dimensions of the refrigeration appliance or thickness of a heat insulation layer surrounding the inner container. Thus depending on the wall distance different variants of the evaporator assembly are required in order to manufacture different models of refrigeration appliances.

A further problem results from the fact that the conventional manufacture of inner containers by means of deep-drawing is afflicted with high tolerances. To ensure a secure engagement of the holding contours in spite of these tolerances, the holding contours must not be too small, yet the more significantly the holding contours of the inner container are deflected against the side wall, the lower their wall thickness and consequently their load-bearing capacity. To achieve an adequate load-bearing capacity of the holding contours, it may be necessary to select the wall thickness of the flat material, from which the inner container is deep-drawn, to be higher than would be the case for an inner container without the holding contours, which in turn increases manufacturing costs.

For a cost-effective manufacture, it would be desirable to use an identical model of the evaporator assembly in refrigeration appliances with different wall distances and to be able to dispense with the holding contours on the inner container.

SUMMARY OF THE INVENTION

The present invention fulfills this requirement by providing a mounting element in the case of a refrigeration appliance with an inner container, which separates at least one storage compartment for refrigerated goods and an evaporator assembly from a surrounding heat insulation layer. The mounting element has a base plate resting against a wall of the inner container and opposing a broad side of the evaporator assembly. Retaining webs project from the base plate and engage in a form-fit manner into two narrow sides of the evaporator assembly.

A refrigeration appliance is understood to refer in particular to a domestic refrigeration appliance, in other words a refrigeration appliance which is used for domestic management in households or possibly also in the catering industry, and in particular which is used to store food and/or beverages in quantities typical for households at certain temperatures, such as a refrigerator, an upright freezer, a combination fridge-freezer, a chest freezer or a wine storage cabinet for example.

Since the retaining webs take over the task of conventional holding contours of the inner container, the latter can be omitted. As a result it is possible to manufacture the inner container with simpler, more cost-effective tools, and when the wall thickness of the flat material used for the inner container is defined, the holding contours no longer need to be taken into consideration.

The mounting element can be molded easily and cost-effectively in one piece from flat material, in particular sheet metal.

Projections which face one another can be molded on a lower edge of the retaining webs in order to support the evaporator assembly. The projections can be obtained by bending a lower edge strip of the retaining webs particularly if the mounting element is formed from flat material as mentioned above. Since the projections can extend across essentially the whole width of the retaining webs, they can contribute to preventing air from circulating through a gap between the retaining webs and the front ends of the evaporator assemblies opposing them, so that when the refrigeration appliance is assembled, air which flows through an evaporator chamber accommodating the evaporator assembly is essentially routed entirely through the evaporator.

The narrow sides of the evaporator assembly can each have a vertically extended groove, into which a projection of one of the retaining rods engages, in order to facilitate the attachment of the evaporator assembly to the mounting element and to keep it in a stable position on the mounting element.

To facilitate insertion of the projections into the grooves, the grooves are preferably open toward the broad side of the evaporator assembly that faces the base plate.

In order to fixedly predetermine the installation position of the mounting element or of the evaporator assembly in the inner container, provision can be made for the mounting element to engage into a condensation outlet channel molded below the evaporator assembly in the inner container.

A support that is angled away from a lower edge of the base plate of the mounting element preferably lies on the base of the condensation outlet channel so that the weight of the mounting element and the evaporator assembly can be braced at least partially by the condensation outlet channel.

In order to fix the position of the mounting element, the base plate can be adhered to the inner container. Therefore through holes in the inner container, through which under unfavorable conditions material of the heat insulation layer could penetrate the interior of the inner container or moisture from the inner container could enter the heat insulation layer, are avoided. A bonding using adhesive tape may be sufficient particularly if the bonding is not solely responsible for bearing the weight of the mounting element and the evaporator assembly. Such an adhesive tape is most effective if it extends across both sides of an upper edge of the base plate, in order to adhere to the base plate below the edge and to the top of the inner container.

The evaporator assembly may contain a fin evaporator and two adapters which form the narrow sides of the evaporator assembly. Adapters which connect closely to the evaporator and to the mounting element in order to route the air circulating in the evaporator chamber as completely as possible through the evaporator can be realized easily and cost-effectively as moldings made from plastic.

A fin evaporator typically has a plurality of plate-shaped fins and a refrigerant pipe, which has multiple curves and is introduced into openings in the fins so that curved pipes protrude beyond the outermost fins on both front ends of the evaporator. These curved pipes can be used to fasten the adapters thereto by clipping them on.

A holder for a defrosting heater can also be molded on at least one of the adapters.

To facilitate installation of the evaporator into the refrigerant circuit of the refrigeration appliance, it is also useful if a refrigerant pipe runs in a self-supporting manner between a breakthrough, at which it crosses the inner container and a passage through a fin of the evaporator on a stretch which corresponds at least to half the width of the evaporator. The refrigerant pipe can therefore be inserted into the breakthrough from the interior of the inner container and the evaporator assembly on the wall of the inner container can then be moved again in order to engage with the mounting element.

However, in the self-supporting stretch, a connection is preferably formed between two pipe sections in the refrigerant pipe, so that the evaporator assembly can first engage with the mounting element in order, in a subsequent assembly step, to establish the connection between a pipe section in the evaporator assembly and a pipe section which extends through the breakthrough.

Other features which are considered as characteristic for the invention are set forth in the appended claims.

Although the invention is illustrated and described herein as embodied in a refrigeration appliance with an internal evaporator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
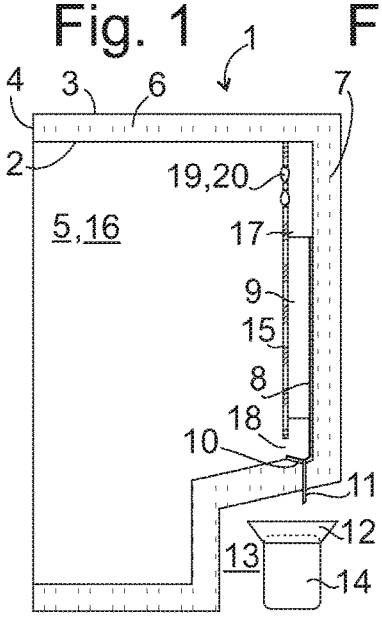
FIG. 1 is a diagrammatic, vertical sectional view through a body of a refrigeration appliance according to the invention.

Referring now to the figures of the drawings in detail and first, particularly to FIG. 1 thereof, there is shown a schematic sectional view through a body or carcass 1 of a domestic refrigeration appliance along a sectional plane which extends vertically and in the depth direction. The body 1 has, in a known manner, an inner container 2 deep drawn in one piece from plastic and an outer membrane 3 composed of plate-shaped sheet metal, which is connected to the inner container on a front side 4 of the body 1 in order to form a cavity, which, together with a non-illustrated door, surrounds an interior 5 and in the course of the assembly of the appliance is filled with a heat insulation layer 6 made from foam.

An evaporator assembly 9 is mounted on a rear wall 7 of the body 1 with the aid of a mounting element 8 described in more detail below. A broad side of the substantially square evaporator assembly 9 faces the rear wall 7. A condensation outlet channel 10 is embedded below the evaporator assembly 9 in the inner container 2 at the foot of the rear wall 7. A drain connection 11 extends from a lowest point of the condensation outlet channel 10 through the heat insulation layer 6 into an evaporator pan 12, which, in a manner known per se, is mounted in a machine space 13 in thermal contact with a compressor 14 accommodated there.

The interior 5 is divided by a wall plate 15 into at least one storage compartment 16 for refrigerated goods and an evaporator chamber 17, which contains the evaporator assembly 9. The evaporator chamber 17 and storage compartment 16 communicate by way of two passages 18, 19. A ventilator 20 is arranged on one of these, in order to drive the air circulation through the evaporator chamber 17 and the air exchange with the refrigerator compartment 16.

When assembling the refrigeration appliance, the evaporator assembly 9 must first be mounted on the rear wall 7 and connected to the compressor 14 by way of pipes, before the wall plate 15 and the ventilator 20 can be mounted.

Figure 2:
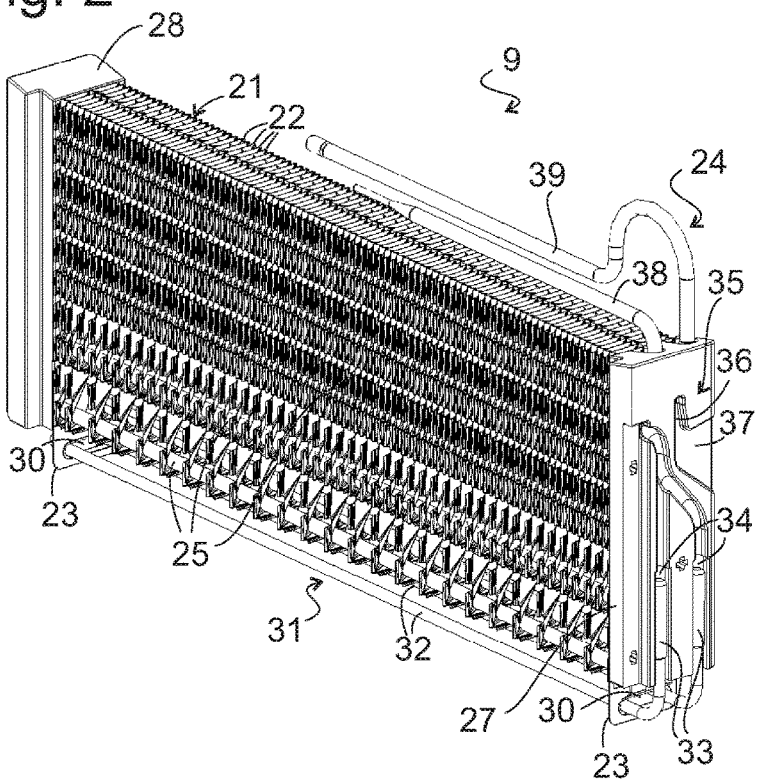
FIG. 2 is a perspective view of an evaporator assembly of the refrigeration appliance from FIG. 1.

An evaporator 21 forms the center of the essentially square evaporator assembly 9. It is preferably embodied as a fin evaporator, as shown in FIG. 2. In a manner known per se the fin evaporator contains a plurality of plate-shaped fins 22, 23 made of sheet metal and a refrigerant pipe 24, of which straight sections 25 cross the fins 22, 23 at right angles and are connected with one another by curved pipes 26 (concealed in FIG. 2), which project beyond their outer fins 23 at the front ends of the fin evaporator.

Two adapters 27, 28 form opposing narrow sides of the evaporator assembly 9. They each cover the two outer fins 23 of the evaporator 21. The adapters 27, 28 are molded in a plate shape or flat square shape and are made from plastic, preferably from expanded plastic such as polystyrene. On one side they have recesses 29 (see FIG. 6), into which one of the curved pipes 26 is clamped in each case. In order to fasten the adapters 27, 28 to the evaporator 21, it is therefore sufficient to impress them onto the curved pipe 26.

Individual fins of the evaporator 21, here the two outer fins 23, project downward beyond the lower edges of the other fins 22 and are provided in each case with an opening 30, which is provided to hold a defrosting heater 31 at a slight distance below the lower edges of the fins 22. A temperature sensor can also be arranged on one of these fins 23 and serves to monitor and identify the defrost process to determine when the evaporator 21 is completely defrosted and the defrosting heater 31 can be switched off again.

The defrosting heater 31 contains a heating element rod 32, which is bent in the shape of a hair pin and is introduced into the openings of the fins 23, as well as two end sections 33, which are clamped into grooves 34 on the side of the adapter 27 facing away from the evaporator 21.

On their side facing away from the evaporator 21 both adapters 27, 28 also have a vertically extended hook-type groove 35 which runs vertically downward in a section 36 away from a vertex and finally deviates toward the rear wall 7 in order, at the end of an oblique section 37, ultimately to lead to the broad side of the evaporator assembly 9 that faces the rear wall 7.

The ends of two grooves which open toward the evaporator 21 and through which two end pieces 38, 39 of the refrigerant pipe 24 extend are visible on an upper edge of the adapter 27. Above the adapter 27 the end pieces 38, 39 are bent in the direction of the opposing adapter 28 and ultimately extend to just above the center of the evaporator 21.

Figure 3:
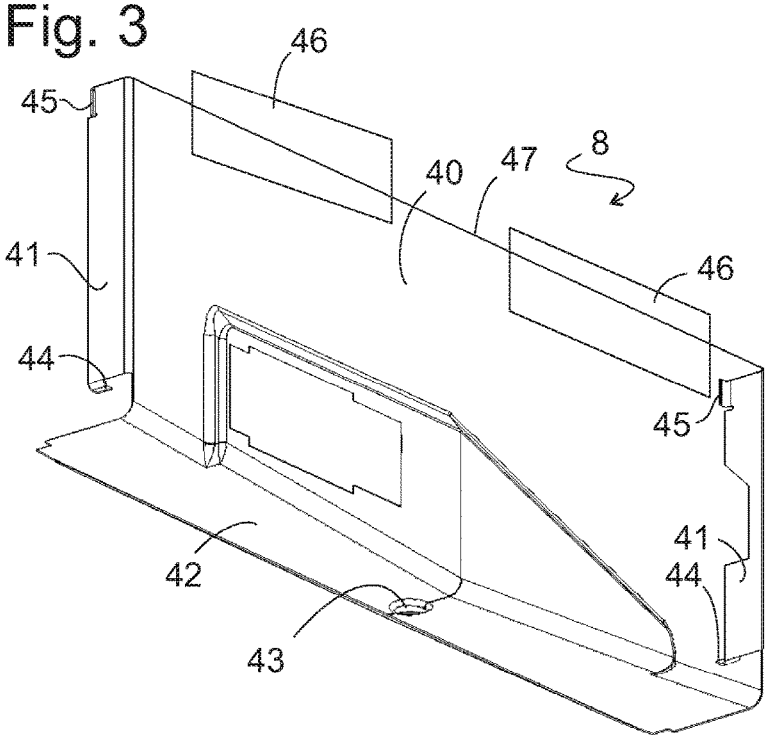
FIG. 3 is a perspective view of a mounting element for supporting the installation of the evaporator assembly in the refrigeration appliance.

FIG. 3 shows the mounting element 8 from the same perspective as the evaporator assembly 9 in FIG. 2. The mounting element 8 is molded in one piece from a sheet metal blank. Edge areas of the blank are bent at three edges in order to form a base plate 40, retaining webs 41 which are angled on lateral edges of the base plate 40 and oppose one another and a support 42 which is angled on its lower edge.

The support 42 is formed here as a channel which extends continuously along the entire lower edge of the base plate 40, the course of which reproduces the condensation outlet channel 10, including an outflow opening 43 at the lowest point in the support 42. As a result of the varying inclination of the support 42 on various sides of the outflow opening 43, a position, in which the mounting element 8 can be positioned in a stable manner in the condensation outlet channel 10 and the outflow opening 43 overlaps with the drain connection 11, also then clearly defines when the mounting element 8 is narrower than the rear wall 7.

Figure 4:
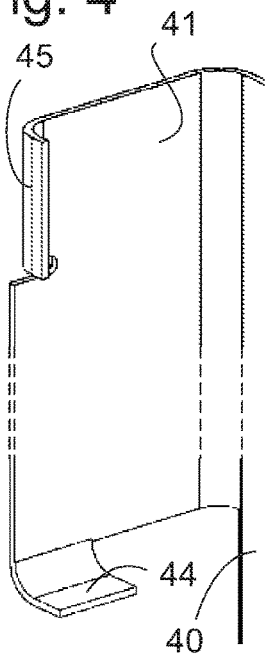
FIG. 4 is an perspective view of details of the mounting element.

The retaining webs 41 are formed here as upright rectangles. On a lower edge of each of these rectangles, as shown enlarged in FIG. 4, an elongated projection 44 is formed in the depth direction of the body 1 by angling an edge strip. A further edge strip is angled on an upper corner of the retaining webs 41, in order to form a vertically extended projection 45 in each case.

The mounting element 8 can be installed upstream of the evaporator assembly 9 in the inner container 2, by its support 42 being placed into the condensation outlet channel 10 so that the base plate 41 comes to rest on the rear wall 7. In this position the mounting element 8 can be fixed by, as shown in FIG. 3, at least one piece of adhesive tape 46 being attached so as to bridge an upper edge 47 of the base plate 41 so that one part of the adhesive tape 46 adheres to the base plate 41 and the other part by way of the upper edge 47 to the rear wall 7. In a next step the evaporator assembly 9 is then installed, by the oblique sections 37 of the two grooves 35 firstly being slid onto the projections 45 of the two retaining webs 41 and then the evaporator assembly 9 being lowered so that the projections 45 couple into the vertical sections 36 of the grooves 35 and the adapters 27, 28 come to rest on the projections 44. In this position the end pieces 38, 39 of the refrigerant pipe 24 can now be connected in a tight manner to pipe sections 48, 49, which extend through breakthroughs 50 in the inner container 2 in the rear wall 7 to the compressor 14. The connections 51 between the end pieces 38, 39 and the pipe sections 48, 49 may be soldered or screwed joint connections in particular.

Once the evaporator 21 has been assembled and fitted into the refrigerant circuit of the refrigeration appliance in this way, the wall plate 15 and possibly the ventilator 20 which has possibly already been preassembled on the passage 19 of the wall plate 15 can be fitted.

Figure 5:
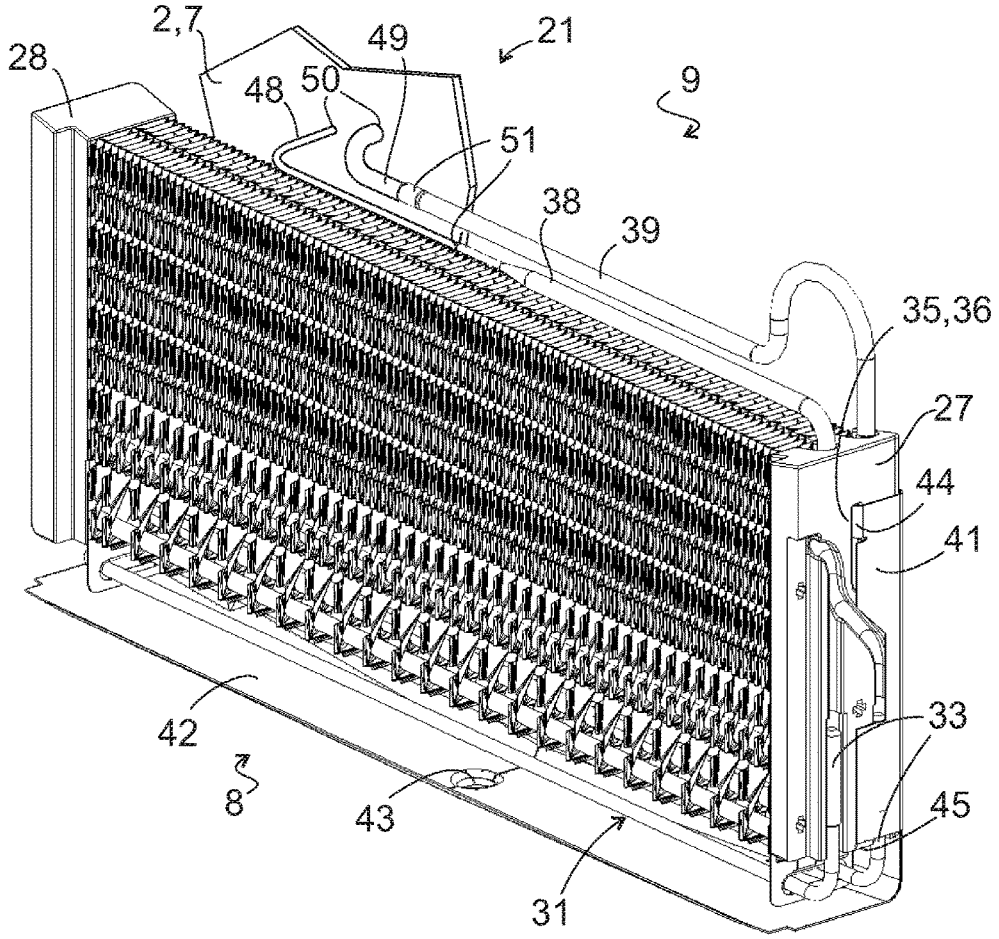
FIG. 5 is a perspective view of the evaporator assembly fitted into the mounting element.

Alternatively, the mounting element 8 and evaporator assembly 9 can already be joined to form an assembly prior to being installed in the interior 5, in which, as shown in FIG. 5, the projection 45 engages in the groove 35 of the adapter 27 and the lower edge of the adapter 27 is supported by the projection 44 which engages between the end sections 33 of the defrosting heater 31. The installation position of the module is also fixedly predetermined here by engagement of the support 42 into the condensation outlet channel 10; a fastening in this installation position can take place by an adhesive being applied in advance to the base plate 40 and this then being pressed against the rear wall 7, for instance.

Figure 6:
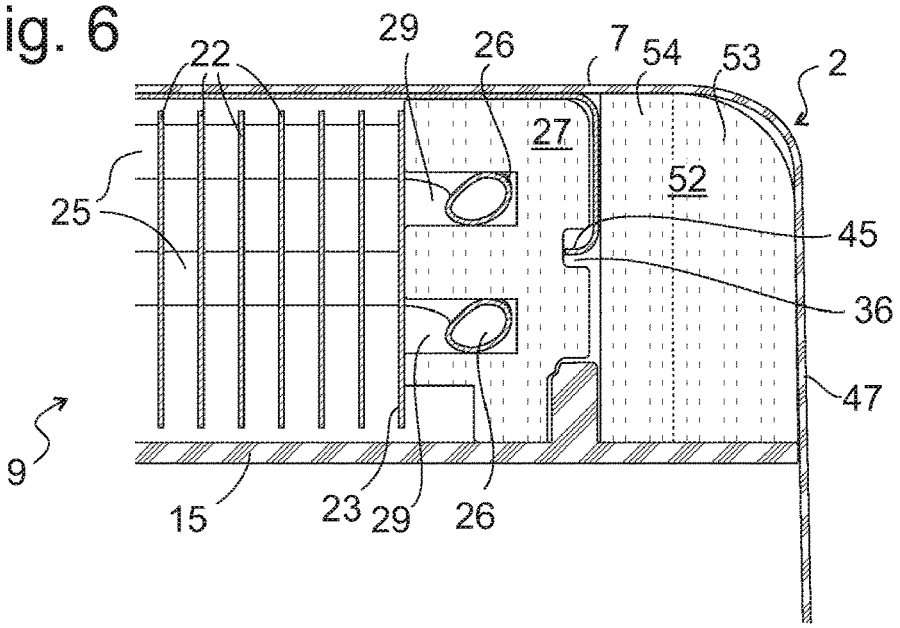
FIG. 6 is a horizontal sectional view through a corner of the body.

FIG. 6 shows a section through a corner of the inner container 2 along a horizontal plane at the height of the upper projections 45 of the retaining webs 41. The curved pipes 26 of the evaporator 21 cross the sectional plane, and recesses 29 on a side of the adapter 27 that faces the evaporator 21 and in which the curved pipes 26 engage, are clearly visible.

A gap between the rear wall 7, a side wall 47 of the inner container 2, the side of the adapter 27 that faces away from the evaporator 21, and the wall plate 15 is filled by a body 52, in order to prevent the flow of air powered by the ventilator 20 in the evaporator chamber 17 from laterally circumventing the evaporator 21. Like the adapter 27 the body 52 can itself be manufactured from foamed plastic, in particular polystyrene. An identical model of the evaporator assembly 9 can be used in inner containers 2 of different widths by the carcass 52 being provided in different widths. Therefore in the case of an inner container 2 with a minimal width the body 52 can be completely missing and the retaining webs 41 on both sides of the mounting element 8 rest directly against the side walls 47 of the inner container, while with an inner container which is wider by a value d of e.g. 5 cm, a body 52 with the width d is fitted in between just one of the two retaining webs 41 and the opposing side wall 47 and with an inner container which is wider by 2*d*, a body 52 is fitted in on each side of the mounting element 8.

If, as in the case in FIG. 6, the retaining webs 41 are not molded such that they are able to nestle closely against the side wall 47 and a body 52 is also required in the case of the inner container 2 with a minimal width in order to prevent the air flow from laterally circumventing the evaporator assembly 9, bodies 52 with different widths can then be made available for inner containers 2 with different widths or the body 52 can, as illustrated in FIG. 6 by a dashed line, consist of an outer part 53 resting against a rear and side wall 7, 47 of the inner container 2 and, if necessary, of one or a number of disks 54 with thickness d or d/2 which are fitted in between the outer part 53 and the adapter 27 or 28, the number of which is defined depending on the width of the inner container 2.

The following is a summary list of reference numerals and the corresponding structure used in the above description of the invention:

1 Carcass
2 Inner container

3 Outer membrane
4 Front side
5 Interior
6 Heat insulation layer
7 Rear wall
8 Mounting element
9 Evaporator assembly
10 Condensation outlet channel
11 Drain connection
12 Evaporation pan
13 Machine space
14 Compressor
15 Wall plate
16 Storage compartment
17 Evaporator chamber
18 Passage
19 Passage
20 Ventilator
21 Evaporator
22 Fin
23 Fin
24 Refrigerant pipe
25 Straight section
26 Curved pipe
27 Adapter
28 Adapter
29 Recess
30 Opening
31 Defrosting heater
32 Heating element rod
33 End section
34 Groove
35 Groove
36 Vertical section
37 Oblique section
38 End piece
39 End piece
40 Base plate
41 Retaining web
42 Support
43 Outflow opening
44 Projection
45 Projection
46 Adhesive tape
47 Side wall
48 Pipe section
49 Pipe section
50 Breakthrough
51 Connection
52 Body
53 Outer part
54 Disk

The invention claimed is:

1. A refrigeration appliance, comprising:

at least one storage container;

an evaporator assembly having a broadside and two narrow sides;

a heat insulation layer surrounding said evaporator assembly and said at least one storage container;

at least one inner container separating said at least one storage container for refrigerated goods and said evaporator assembly from said heat insulation layer, said inner container having a wall; and a mounting element having a base plate resting against said wall of said inner container and opposing said broad side of said evaporator assembly, and retaining webs projecting from said base plate and engaging in a form-fit manner into said two narrow sides of said evaporator assembly, said retaining webs having a lower edge with projections facing one another, and on said projections said evaporator assembly is supported, said retaining webs each having a lower edge strip and said projections are formed by bending said lower edge strip of said retaining webs.

2. The refrigeration appliance according to claim 1, wherein said mounting element is formed in one piece from a flat material.

3. The refrigeration appliance according to claim 1, wherein said narrow sides of said evaporator assembly each have a vertically extended groove formed therein, in said vertically extended groove a projection of one of said retaining webs engages.

4. The refrigeration appliance according to claim 3, wherein said vertically extended groove is open toward said broad side of said evaporator assembly that faces said base plate.

5. A refrigeration appliance, comprising:

at least one storage container;

an evaporator assembly having a broadside and two narrow sides;

a heat insulation layer surrounding said evaporator assembly and said at least one storage container;

at least one inner container separating said at least one storage container for refrigerated goods and said evaporator assembly from said heat insulation layer, said inner container having a wall;

a mounting element having a base plate resting against said wall of said inner container and opposing said broad side of said evaporator assembly, and retaining webs projecting from said base plate and engaging in a form-fit manner into said two narrow sides of said evaporator assembly; and a condensation outlet channel molded in said inner container below said evaporator assembly, said mounting element engaging in said condensation outlet channel.

6. The refrigeration appliance according to claim 5, wherein:

said condensation outlet channel has a base; and said mounting element has a support that is angled away from a lower edge of said base plate and rests on said base of said condensation outlet channel.

7. The refrigeration appliance according to claim 1, wherein said base plate adheres to said inner container.

8. A refrigeration appliance, comprising:

at least one storage container;

an evaporator assembly having a broadside and two narrow sides, said evaporator assembly having a fin evaporator and two adapters forming said narrow sides of said evaporator assembly;

a heat insulation layer surrounding said evaporator assembly and said at least one storage container;

at least one inner container separating said at least one storage container for refrigerated goods and said evaporator assembly from said heat insulation layer, said inner container having a wall; and a mounting element having a base plate resting against said wall of said inner container and opposing said broad side of said evaporator assembly, and retaining webs projecting from said base plate and engaging in a form-fit manner into said two narrow sides of said evaporator assembly.

9. The refrigeration appliance according to claim 8, wherein said adapters are molded parts made from plastic.

10. The refrigeration appliance according to claim 8, wherein said fin evaporator has curved pipes and said adapters are clipped onto said curved pipes.

11. The refrigeration appliance according to claim 8, wherein said evaporator assembly has a defrosting heater and a holder for said defrosting heater, said holder is formed on at least one of said adapters.

12. The refrigeration appliance according to claim 8, further comprising a body and a gap between at least one of said adapters and a side wall of said inner container is filled by said body.

13. The refrigeration appliance according to claim 8, wherein said inner container has a breakthrough formed therein;

wherein said fin evaporator has a fin with a passage; and further comprising a refrigerant pipe running in a self-supporting manner between said breakthrough, at which said refrigerant pipe crosses said inner container, and said passage through said fin of said fin evaporator on a stretch which corresponds to at least half a width of said fin evaporator.

14. The refrigeration appliance according to claim 13, wherein said refrigerant pipe has pipe sections and a connection disposed between two of said pipe sections is formed in a self-supporting stretch.

15. The refrigeration appliance according to claim 11, wherein:

said defrosting heater has end pieces; and at least one of said adapters has grooves formed therein, said grooves functioning as said holder and receives said end pieces.

16. The refrigeration appliance according to claim 2, wherein said flat material is sheet metal.

17. The refrigeration appliance according to claim 7, further comprising an adhesive tape extending on both sides of an upper edge of said base plate for adhering said base plate to said inner container.

18. The refrigeration appliance according to claim 9, wherein said plastic is an expanded plastic.

* * * * *